United States Patent [19]

Tison et al.

[11] 4,372,206

[45] Feb. 8, 1983

[54] DEVICE FOR CONTROLLING THE MOVEMENT OF A WEB THROUGH A PRINTING MACHINE

[75] Inventors: Eric Tison, Perthes; Paul Herve, Viry-Chatillon, both of France

[73] Assignees: Codimag, Perthes; Ets. Destouche, S. Orge, both of France

[21] Appl. No.: 224,541

[22] PCT Filed: Apr. 18, 1980

[86] PCT No.: PCT/FR80/00060

§ 371 Date: Dec. 9, 1980

§ 102(e) Date: Dec. 9, 1980

[87] PCT Pub. No.: WO80/02258

PCT Pub. Date: Oct. 30, 1980

[30] Foreign Application Priority Data

Apr. 18, 1979 [FR] France ..... 79 09719

[51] Int. Cl.[3] ..... B41F 13/54

[52] U.S. Cl. ..... 101/228; 226/143

[58] Field of Search ..... 101/139, 143, 92, 178, 101/213, 225, 228; 226/143, 153, 149

[56] References Cited

U.S. PATENT DOCUMENTS 2,039,236 4/1936 Meisel .
2,845,021 7/1958 Pinckert et al. .
3,420,158 1/1969 Kobiella ..... 226/143 X
3,548,747 12/1970 D'Amato ..... 101/228 X
3,762,322 10/1973 Vines ..... 101/228

FOREIGN PATENT DOCUMENTS 2025390 9/1970 France .
2342849 9/1977 France .

*Primary Examiner*—A. J. Heinz
*Attorney, Agent, or Firm*—Fleit & Jacobson

[57] ABSTRACT

The invention relates to the movement of a web through a printing machine.

The web is caused to move forward during each cycle, alternately at the printing speed during printing and at a take-up speed which is at most equal to the printing speed, the excess length arising from the difference between the printing speed and the take-up speed, in the case where the latter is less than the printing speed, being re-absorbed by pulling the web backwards without stopping the web. A typical device comprises, downstream of the printing cylinder 2, a first endless rotary member 9 for conveying the web at the printing speed, and a second endless rotary member 12 for conveying the web at the take-up speed.

Application to paper in the form of webs of widely varying substances and quality.

7 Claims, 6 Drawing Figures

DEVICE FOR CONTROLLING THE MOVEMENT OF A WEB THROUGH A PRINTING MACHINE

The invention relates to a process for controlling the format to be printed of a web which feeds, without tension, a printing machine with a rotary printing cylinder, this machine operating in successive cycles, each cycle being defined as one rotation of the printing cylinder and involving the printing of one area of the web in the said format.

The object of the invention is to permit easy changing of the format, that is to say of the length of web which moves through the machine for each cycle.

This is achieved, according to the invention, by determining this format by means of the take-up speed of the web during the cycle.

In a typical embodiment of the invention, the web is caused to move forward during each cycle, alternately at the printing speed during printing and at a take-up speed which is at most equal to the printing speed, the excess length arising from the difference between the printing speed and the take-up speed, in the case where the latter is less than the printing speed, being reabsorbed by pulling the web backwards without stopping the web between the movement at the take-up speed and the movement at the printing speed.

According to the invention, successive starting and stopping movements are thus avoided.

The invention applies to all printing processes (letterset, dry offset, wet offset and gravure) and it makes it possible to use paper in the form of webs of widely varying substance and quality.

The invention also relates to devices for carrying out the process of the invention.

BRIEF DESCRIPTION OF THE DRAWINGS

These devices will be described with reference to the figures of the attached drawings, in which.

Figure 1:
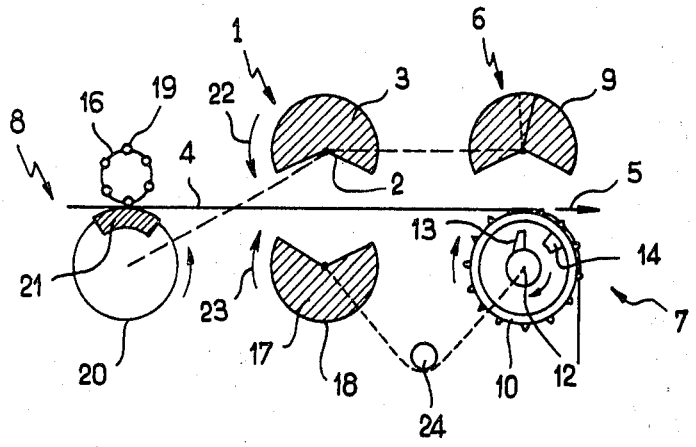
FIG. 1 schematically illustrates one embodiment of a printing machine according to the present invention during a portion of a printing cycle in which a web is being pulled back through the machine.

The device shown in FIGS. 1 to 6 comprises a printing machine 1 represented schematically by a printing cylinder 2, possessing a printing surface 3 which, in the example, will be assumed to cover three-quarters of the surface of the cylinder, and by an impression cylinder 17. For the clarity of the drawing, the other accessories of the printing device have not been shown. The printing cylinder acts on the web 4 when there is contact between this web and the printing surface, by virtue of the pinching of the web between the printing surface 3 and a counterpart surface 18 of the cylinder 17.

The device shown comprises, downstream of the printing machine, in the direction of movement of the web shown by the arrow 5, a device 6 for drawing the web in the direction of the arrow 5 at a speed equal to the printing speed, and a device 7 for drawing the web in the direction of the arrow 5 at a take-up speed.

The device also comprises, upstream of the machine 1, a pulling-back device 8 for pulling the web back in the opposite direction to the normal direction of movement 5.

The device 6 is designed to convey the web in synchronisation with the printing, that is to say that the beginning and the end of this conveying coincide with the beginning and the end of the printing, and that the conveying speed coincides with the tangential speed of the printing cylinder, the latter speed having been referred to as the "printing speed".

The device 6 consists, for example, of a cam, the surface of which has the same shape and the same angular dimensions as the printing surface, this cam being caused to rotate at the same speed as the printing cylinder, and the angular positions of this cam and of the printing surface being identical in order to obtain the desired coincidences of the contacts with the web. In the figures, this cam is represented schematically by a sector 9 of a circle.

The device 7 is designed to convey the web at a chosen speed, referred to as the "take-up speed", which is at most equal to the printing speed. In a preferred embodiment, this device comprises a wheel 10 provided with sprockets 11 which are capable of engaging with perforations located at intervals along the web (for example so-called "Caroll" perforations), this wheel being mounted loose, coaxially with a rotor 12 which continuously rotates at the take-up speed and which is fitted with a stop 13 capable of coming into contact with a stop 14 on the wheel, so as to drive the latter at the take-up speed.

Preferably, the cam 9 and the sprocket wheel 10 are located opposite one another, as shown, but, in modified embodiments, they are staggered, the cam being downstream of the wheel.

The device 8 is designed to exert a certain tension continuously on the web and to pull the web 4 backwards after each printing operation, in the case where this is necessary, that is to say if the printing speed is greater than the take-up speed. This device 8 comprises a rotor 16 with peripheral balls 19 and a cooperating rotor 20 with a cam 21. The web is normally kept tight by friction between the balls 19 and the surface of the rotor 20, but, when the cam 21, which projects, passes into contact with the web, the friction becomes sufficient to exert a pulling-back force on the web. The cam 21 is synchronised with the printing surface so that the beginning of the pulling-back contact of the web by this cam coincides with the end of the printing contact of the printing surface 2 with the web.

A printing cycle will now be described, it being assumed that the cycle starts a short time before the start of a printing operation and ends a short time after the end of a printing operation.

Figure 2:
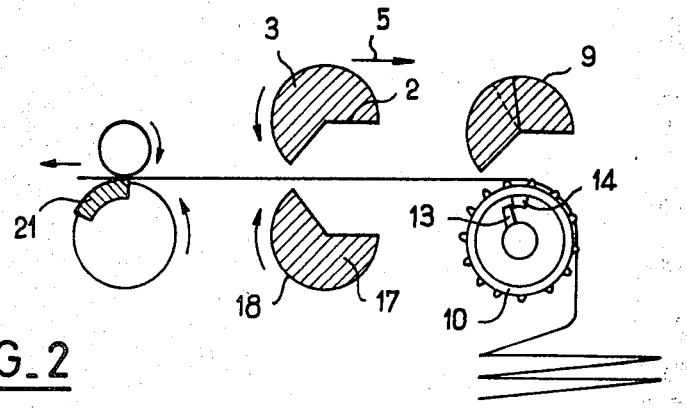
FIG. 2 is a view of the printing machine of FIG. 1 at the end of pulling back of the web.

FIG. 2 shows the start of the cycle. The web is free except for being engaged with the sprocket wheel 10, the stop 14 of which is driven by the stop 13 of the rotor 12 at the take-up speed; the web thus moves forward at this speed in the direction of the arrow 5, the pulling-back by the cam 21 having ended.

Figure 3:
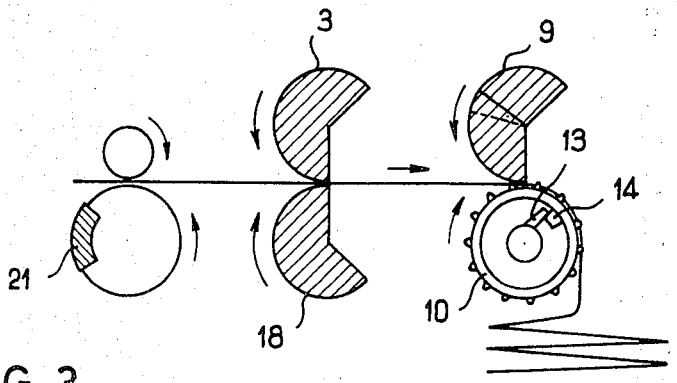
FIG. 3 is a view of the printing machine of FIG. 1 at the start of a printing operation.

It is now assumed that the printing surface comes into printing contact with the web (FIG. 3). At this moment, the conveying cam of the device 6 also comes into conveying contact with the web.

Figure 4:
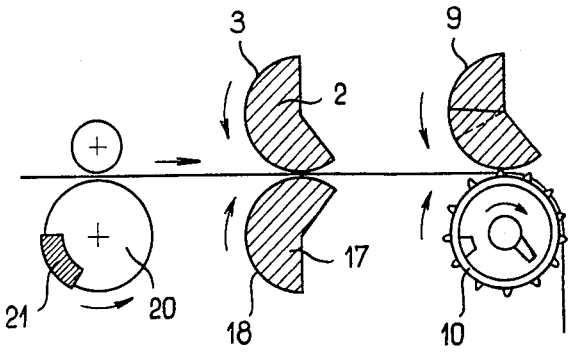
FIG. 4 is a view of the printing machine of FIG. 1 during a printing operation.
Figure 5:
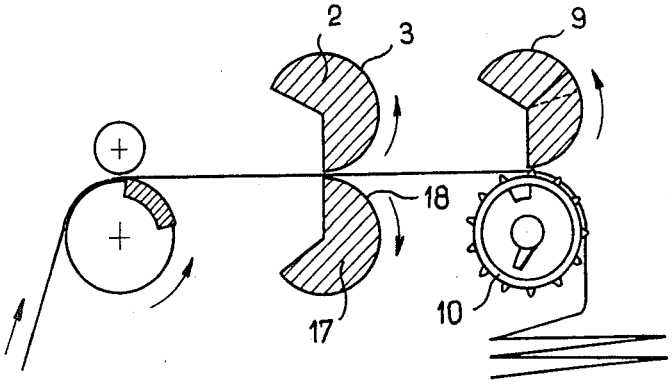
FIG. 5 is a view of the printing machine of FIG. 1 at the end of a printing operation.

The following stage is a printing stage, during which the printing surface is in printing contact with the web, and during which the web is drawn forwards by the cam 9. As this traction takes place at a speed greater than the take-up speed, the sprocket wheel can no longer convey the web, but, on the contrary, the web imposes its speed, which is now the printing speed, on the sprocket wheel, the stop 14 of which goes ahead of the stop 13 on the rotor 12 rotating at the take-up speed, which is less than the printing speed; FIG. 4 schematically represents this stage and shows that there is an angular separation between the stops 13 and 14.

It is now assumed that the printing stage has ended (FIG. 5), at which point on the one hand the printing contact of the surface 2 and the web 4, and on the other hand the conveying contact of the cam 9 and the web 4, will stop, the web thus being released, whilst, simultaneously, the pulling-back contact of the cam 21 and the web will start.

Under the pulling-back effect of the cam 21, the web moves backwards and carries the sprocket wheel in its movement, the stop of which sprocket wheel also moves backwards to approach the stop 13 on the rotor, which has continued to rotate in the direction of the take-up speed (FIG. 1).

When this contact is made, the rotor 12 can again convey the web at the take-up speed, by means of the sprocket wheel, until the printing surface is again in contact with the web, at which point the second cycle has already started.

FIG. 1 shows the diagram of the control of the various rotary members from a common source of movement. There is a gear (not shown) between the cylinders 2 and 17 so that they rotate in opposite directions. If it is assumed that the printing cylinder is a drive cylinder which rotates in the direction of the arrow 22, drive links are produced between this cylinder and the rotors 9 and 20 so that the cams 9 and 21 rotate in the same way as the drive cylinder. The impression cylinder 17 rotates in the opposite direction 23 and a drive link, comprising a pinion 24, is set up between the cylinder 17 and the rotor 12 so that the rotor rotates in the same direction as the cylinder 17 but at a speed which depends on the choice of pinion. In the figure, the drive links are represented schematically by broken lines.

EXAMPLE

The sprocket traction device 10 conveys the paper at a constant continuous speed. The format considered for one cycle will be, for example, 12 inches.

The cam 9 and the printing cylinder 2 rotate at a continuous and constant speed. One revolution of the cylinder corresponds to one cycle. The cylinders 2 and 17 have a gap of 6½ inches. When the cylinders are in maximum contact, this surface is equivalent to 12½ inches, which gives a total speed of 19 inches per cycle.

The format of the paper is varied by changing a control pinion governing the take-up of the paper, which in this case is the sprocket traction device 10.

Example: the pinion change will give a throughput of 10 inches per cycle instead of 12 as explained initially.

The development of the cylinders 9 and 2 will remain 19 inches per cycle. The speed difference is increased by 2 inches.

Figure 6:
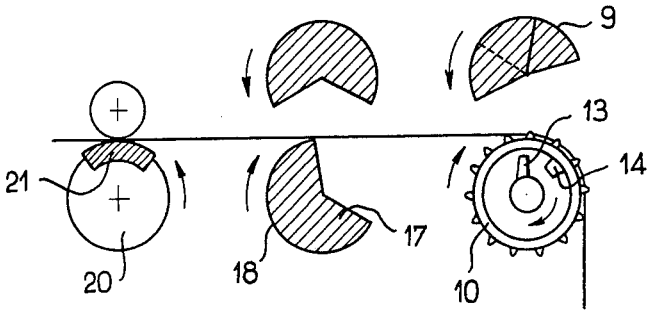
FIG. 6 schematically illustrates a modification of the printing machine of FIG. 1.

To avoid an excessively high throughput of paper during the printing stage, angular adjustment of the counterparts 17 and 9 is carried out. FIG. 6 shows a case where the format is reduced.

The contact time in the cycle will be reduced in order to approach the printing format (the latter can moreover be different from the format of the print). Example: the depth of the print can be less than or equal to the depth of the format, namely 1, 2, 3, 4, 5, 6 . . . inches for a paper format of 10 inches.

The adjustment of the counterpart, relative to the upper part, limits the loop of paper downstream and thus reduces the length of paper to be recovered during the idling time. Furthermore, it increases the idling time per cycle and this compensates the increase in the speed differences (minus→plus, plus→minus) when the format is reduced, leaving a longer recovery time.

In this non-limiting example, the opening in the cylinders 2 and 17 is calculated so that their respective adjustment can pass from the maximum contact surface to a minimum contact surface of half the maximum contact.

The variation in format corresponds to the choice of the ratio of the gear train which controls the forward movement of the paper. If one tooth of the format pinion corresponds to 1/6 inch, the variation in format can be carried out every 1/6 inch.

The adjustments make it possible to reduce or increase the contact surface of the web and thus make it possible to maintain a virtually constant return of the web of paper.

The invention is not limited to the means which have been described and encompasses the use of equivalent means.

We claim:

1. A printing machine comprising:

a rotary printing cylinder having a printing speed for printing a web, with the possibility of changing the format, said machine operating in successive printing cycles and each cycle being defined as one rotation of the printing cylinder and involving the printing of one area of the web in the said format;

a first endless traction device and another endless traction device both located downstream of the printing cylinder for engaging and conveying the web independently of one another after it has travelled past the printing cylinder, said first endless traction device conveying the web forwards at a take-up speed which is at most equal to the printing speed and comprising a freely rotating web engaging sprocket device having a stop and a rotor which is continuously driven at the take-up speed, said rotor having a stop which drives the sprocket device by the contact of its stop with the stop of the sprocket device whereby said sprocket device is free to intermittently rotate at a higher speed than the take-up speed but constrained to rotate at the take-up speed when its stop contacts the rotor stop, and said another endless traction device comprising a rotary member for intermittently conveying the web at the printing speed, in synchronisation with printing contact between said printing cylinder and the web; and a device upstream of the printing cylinder for pulling the web backwards in order to re-absorb, during each printing cycle, any excess web length resulting from a difference between conveying at the printing speed and conveying at the take-up speed.

2. Machine according to claim 1, characterised in that the said sprocket device is a freely rotatable wheel mounted coaxially with said rotor.

3. Machine according to claim 1 or 2, wherein said first endless traction device and said another endless traction device are located opposite one another with respect to said web.

4. Machine according to claim 1 or 2, wherein said another endless traction device is a cam, the surface of which has the same angular dimensions as a printing surface of said printing cylinder.

5. Machine according to claim 1 or 2, wherein said device for pulling the web backwards comprises a rotary cam, the angular position of which is adjusted, relative to that of a printing surface of the printing cylinder, in order to come into pulling-back contact with the web when the printing contact of the printing surface with the web has ended.

6. Machine according to claim 1 or 2, further comprising one motor for driving said rotor and said another endless traction device.

7. Machine according to claim 6, wherein said motor also drives the device for pulling the web backwards.

* * * * *